US006640388B2

(12) United States Patent
Covert et al.

(10) Patent No.: US 6,640,388 B2
(45) Date of Patent: Nov. 4, 2003

(54) ASSEMBLY FOR TRANSIT CAR DOOR HANGER

(75) Inventors: Jeffery W. Covert, Libertyville, IL (US); Richard D. Curtis, Munster, IN (US)

(73) Assignee: Morton Manufacturing Company, Libertyville, IL (US)

( * ) Notice: Subject to any disclaimer, the term of this patent is extended or adjusted under 35 U.S.C. 154(b) by 0 days.

(21) Appl. No.: 09/961,877

(22) Filed: Sep. 24, 2001

(65) Prior Publication Data

US 2003/0056685 A1 Mar. 27, 2003

(51) Int. Cl.[7] ..... A47H 13/00

(52) U.S. Cl. ..... 16/87 R; 16/89; 16/93 R; 16/95 R

(58) Field of Search ..... 16/87 R, 87.6 R, 16/88, 89, 43 R, 95 R; 49/116, 409, 410, 411

(56) References Cited

U.S. PATENT DOCUMENTS

| | | | | |
|---|---|---|---|---|
| 680,996 | A | | 8/1901 | Hook |
| 913,261 | A | | 2/1909 | Clark |
| 922,241 | A | | 5/1909 | Bartholomae |
| 1,035,064 | A | | 8/1912 | Westlin et al. |
| 1,229,653 | A | | 6/1917 | Pitt |
| 1,322,918 | A | | 11/1919 | McQueen |
| 3,143,758 | A | | 8/1964 | Dunham |
| 3,319,584 | A | | 5/1967 | Erickson |
| 3,407,536 | A | * | 10/1968 | Nystrom ..... 49/482.1 |
| 3,466,698 | A | | 9/1969 | Nystrom |
| 3,727,349 | A | * | 4/1973 | Bainbridge ..... 49/370 |
| 3,740,898 | A | * | 6/1973 | McKenzie ..... 16/87 R |
| 3,745,705 | A | * | 7/1973 | Reddy ..... 49/139 |
| 3,866,354 | A | * | 2/1975 | Butt ..... 49/139 |
| 4,698,876 | A | | 10/1987 | Karita |
| 4,854,078 | A | | 8/1989 | DePrima |
| 4,915,032 | A | * | 4/1990 | Drews ..... 105/329.1 |

FOREIGN PATENT DOCUMENTS

| | | |
|---|---|---|
| DE | 1559827 | 2/1970 |
| JP | 2000002040 | 1/2000 |

* cited by examiner

*Primary Examiner*—Gary Estremsky
*Assistant Examiner*—Mark Williams
(74) *Attorney, Agent, or Firm*—Marshall, Gerstein & Borun LLP

(57) ABSTRACT

A hanger bar assembly for sliding doors used in transit cars has at least two separate coaxially oriented, preferably tubular bearing segments which can slidingly engage a cylindrical rod secured above an entry portal of a transit car. Each bearing segment contains bearing means such as a ball bushing bearing. The tubular bearing segments can be secured to a hanger bar at selected locations, taking into consideration such factors as the location of door hanger support points above an entry portal of the transit car, the location where the sliding door interfaces with an adjacent sliding door, the horizontal width of the door, and the distance that the door must travel along the cylindrical rod. Each of the bearing segments can be sealed at either end to reduce the likelihood of dirt and other contaminants entering the bearing segments.

11 Claims, 4 Drawing Sheets

ASSEMBLY FOR TRANSIT CAR DOOR HANGER

BACKGROUND

1. Technical Field

The technical field of this disclosure relates generally to a sliding door assembly to allow passengers to rapidly enter and exit transit cars, and more specifically, to hangers used to slidably mount doors at the entry portals of rail transit cars, commuter train cars and other transit vehicles.

2. Description of the Prior Art

For much of the twentieth century, various attempts were made to improve the function, durability and reliability of sliding doors, and in particular, hanger assemblies from which sliding transit car doors are suspended. Because of the rugged environment to which the transit cars are subjected, transit authorities must periodically overhaul existing cars and/or replace the cars entirely. The sliding doors of these new and refurbished transit cars must have the ability to operate with longer periods between maintenance. When maintenance is necessary, the sliding doors should provide easy access to serviceable parts, and, if necessary, be easy to replace.

Many existing transit car door hanger assemblies are heavy, difficult to install and replace, as discussed in Morton Manufacturing Co.'s U.S. Pat. No. 3,466,698, and are not able to be used with a variety of different styles of sliding transit car doors. This requires manufacturers to carry parts for several different types of hanger assemblies to meet the demands of different transit authorities. For example, while some transit cars have sliding doors which are flat, running perfectly perpendicular to the floor of the transit car, many other transit cars have curved sliding doors, creating special challenges from a door hanger design standpoint because the center of gravity of the curved door is not directly below the sliding support. Circular raceways, as opposed to ball bearing supports, were used in the door hangers for curved doors, but these did not perform satisfactorily. U.S. Pat. No. 3,740,898, also owned by Morton Manufacturing Co., addressed this problem by employing sliding blocks that also pivot about a horizontal axis, which prevents binding of the curved door during horizontal sliding movement.

Morton Manufacturing Co.'s U.S. Pat. No. 4,854,078 addressed problems associated with chattering of curved sliding doors along conventional door hanger assemblies, which undesirably resulted in maintenance and down-time, by using a pair of pivot blocks and a hanger bar design that could be easily retrofit in existing transit cars. However, these multi-part assemblies were costly and still required maintenance.

U.S. Pat. No. 4,915,032, attempts to address many problems associated with sliding door hanger assemblies, such as protecting against the accumulation of debris on bearing surfaces, difficulties in installation and adjustment, and poor durability. The '032 patent shows a door hanger assembly that can be used with both curved and flat doors. The door hanger assembly uses cylindrical bearing modules oriented in a single tubular sheath, with one of the bearing modules being located at each end of the tubular sheath, and the tubular sheath maintaining a fixed distance between the two bearing modules. The hanger which supports the door is attached to the lower edge of the tubular sheath, and the sheath and associated bearing members are of substantial size and weight. While the hanger assembly shown in the '032 patent may reduce the likelihood of debris collecting between the bearing modules by encasing the two bearing modules in the tubular sheath, build-up of some debris between the modules is inevitable, and the door hanger of the '032 patent provides no means of access to the portion between the bearing members for cleaning. Another disadvantage is the difficulty of using the door hanger of the '032 patent for transit car doors of various sizes. For example, a different length of a central portion within the tubular sheath must be used for the door hanger to work with doors of different sizes.

It is an object of certain embodiments of the present invention to overcome these and other shortcomings of the prior art.

SUMMARY

The hanger assembly of certain embodiments of the present invention provides a light-weight, easy-to-install and easy-to-maintain system for reliably mounting sliding transit car doors which are substantially flat, as well as doors which have a curved profile. The hanger assembly includes at least two separate tubular bearing segments, each containing a bearing means such as a ball bushing bearing. A suitable ball bushing bearing is available from Thomson Industries, Inc. of Manhasset, N.Y., under the trade name "Super Smart Ball Bushing" bearing, which is available with or without integral wipers. The tubular bearing segments slide along a cylindrical rod that is easily pinned in place above the entry portal of the transit car.

The tubular bearing segments are mounted, for example by welding, to the hanger bar to which the sliding door is directly or indirectly attached. The manufacturer can select the locations along the hanger bar where the tubular bearing segments are mounted by taking into consideration such factors as the location of door hanger support points above the entry portal of the transit car, the location where the sliding door interfaces with an adjacent sliding door, the horizontal width of the door, and the distance that the door must travel along the cylindrical rod. Although these parameters may change depending on each particular size and type of transit car door, the same components can advantageously be used to manufacture the hanger assembly. The manufacturer need not maintain an inventory of separate tubular bearing segments depending on the particular dimensions of the door. Instead, the tubular bearing segments, which can be the same size for many different sizes and types of transit car doors, can advantageously be welded or otherwise secured to certain locations along the hanger bar as warranted by the parameters discussed above.

The hanger bar to which the tubular bearing segments are welded (or otherwise secured) may be a conventional hanger bar, such as shown in U.S. Pat. No. 3,740,898 (with a modification of the hanger bar in which the upper portion is preferably changed to interface with each of the tubular bearing segments, such as by milling depressions in the top of the hanger bar to receive the tubular bearing segments prior to welding, so as to minimize the overall height of the assembly). The hanger bar could also be of other profiles, such as the one shown in FIGS. 1 and 3 of U.S. Pat. No. 4,854,078. The cylindrical rod along which the tubular bearing segments slide is pinned to the top of the frame of the entry portal of the transit car chassis, preferably within a housing or behind an access panel so as to normally be hidden from view. The manner of pinning the cylindrical rod to the top of the frame can be similar to the manner in which U.S. Pat. Nos. 3,740,898 and 4,854,078 showed brackets (used in those patents to support and confine ball bearings)

bolted to the top of the frame by a simple nut, washer, and bolt configuration. The manner in which certain embodiments of the present invention accomplishes these and other advantages over the prior art are described in the Detailed Description of Exemplary Embodiments, with reference to the drawings.

DETAILED DESCRIPTION OF EXEMPLARY EMBODIMENTS

Figure 1:
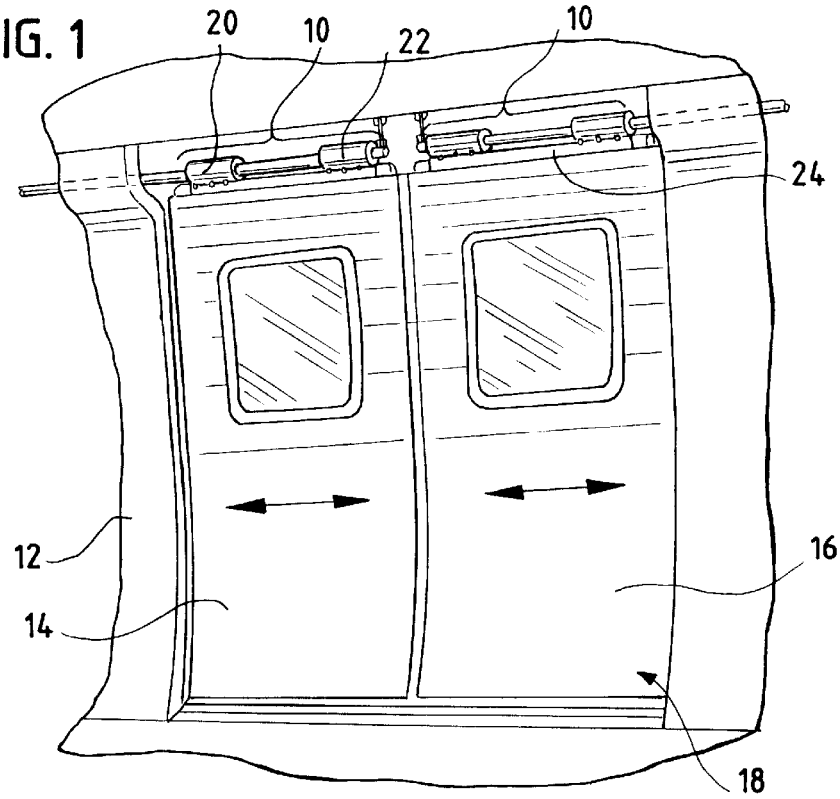
FIG. 1 is an environmental perspective view of a pair of transit car doors slideably mounted above an entry portal of the transit car, showing each door slidingly supported in the closed position on a door hanger assembly of an exemplary embodiment of the present invention.

An exemplary embodiment of the hanger assembly 10 for sliding transit car doors of the present invention is shown in FIG. 1, which is a perspective view, broken away, taken from the interior of a transit car 12. A housing, which normally obscures the hanger assembly 10 from view, but also provides a means of access to the hanger assembly 10 for maintenance, is not shown for purposes of clarity. A pair of transit car doors 14, 16, also referred to herein as sliding doors 14, 16, are slidingly mounted on the hanger assembly 10 at the entry portal 18 of the transit car 12.

Figure 8:
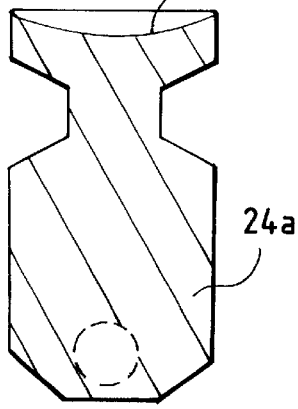
FIG. 8 is a cross-sectional view of a hanger bar having a different shape than the hanger bar shown in FIGS. 5 and 6.
Figure 9:
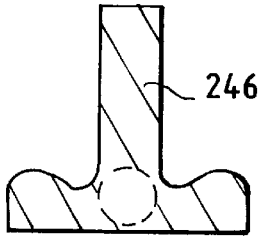
FIG. 9 is a cross-sectional view of a hanger bar having yet another shape than the hanger bars shown in FIGS. 5, 6 and 8.

Each hanger assembly 10 features at least two tubular bearing segments 20, 22. The tubular bearing segments 20, 22 are mounted, preferably by welding, to a hanger bar 24. It is recognized that the hanger bar 24 may take on various shapes, thus the shape of the hanger bar 24 shown in the drawings is by way of example only. A suitable hanger bar 24 for use in accordance with certain embodiments of the present invention would be as shown in U.S. Pat. No. 3,740,898, with some modifications to its top surface to interface with the tubular bearing segment 20. The assembly of these embodiments of invention is capable of accommodating a hanger bar formerly available from the O.M. Edwards Company, Inc. of Syracuse, N.Y., designated part no. M 7815-3, now available from Morton Manufacturing Company of Libertyville, Ill., and shown in FIG. 1 of U.S. Pat. No. 4,854,078. Various other hanger bar shapes could also be used with these embodiments, instead of shape of the hanger bar 24 shown in FIGS. 5 and 6. For example, FIG. 8 is a cross-sectional view of a first such alternate hanger bar 24*a*, and FIG. 9 is a cross-sectional view of a second such alternate hanger bar 24*b*. The tubular bearing segments 20, 22 could be secured, for example by welding, to the top of either of these alternate hanger bars 24*a*, 24*b*. Some reasons for selecting a particular hanger bar shape over another include strength and space limitations, as certain shapes of hanger bars can reduce the overall height of the entire sliding door support assembly, while others may be more desirable for use with doors requiring hanger bars with greater strength. It should be recognized that the hanger bars shown in the drawings are not drawn to scale, and that the overall height of the hanger bars can be significantly less than shown in the drawings.

Figure 2:
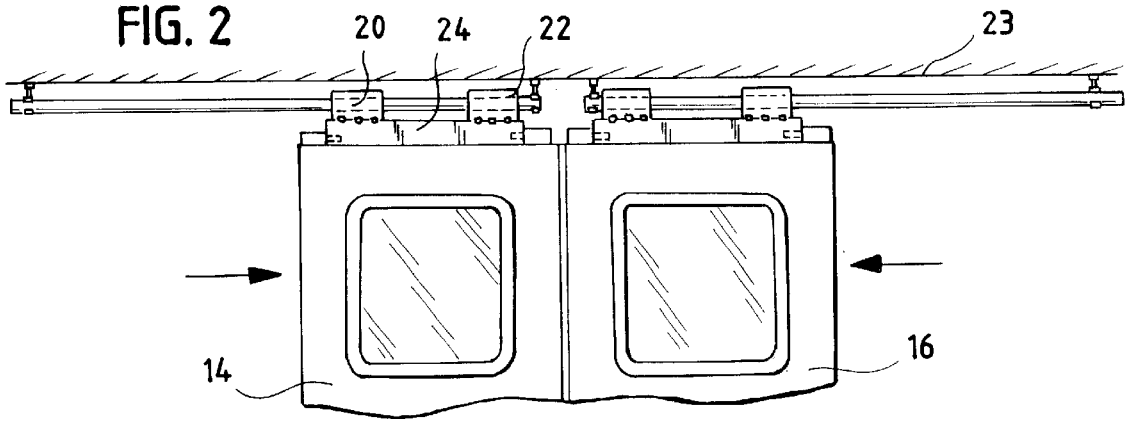
FIG. 2 is a plan view, partially broken away, of a pair of transit car doors, in the closed position, with each door slideably mounted on a door hanger assembly of the embodiment of the present invention shown in FIG. 1.
Figure 3:
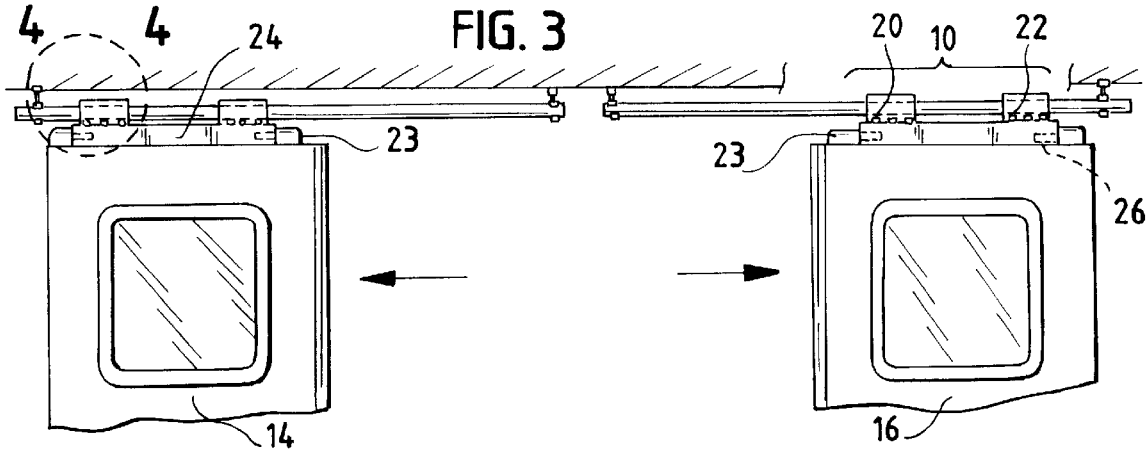
FIG. 3 is a plan view, partially broken away, of the pair of transit car doors shown in FIG. 2, wherein the doors are in the open position.

The manner in which the sliding transit car doors 14, 16 can be attached to the hanger bar 24 is conventional. One suitable such manner of attachment is shown and described in more detail in U.S. Pat. No. 3,740,898, which is incorporated herein by reference. Briefly, a pivot block 23 is provided outwardly of either end of the hanger bar 24. A sliding transit car door 14 includes two such pivot blocks 23 along the top thereof, with one of the pivot blocks 23 being located adjacent each vertical edge of the sliding door 14. Each pivot block 23 is provided with a pivot pin bore 25 therein, as shown in FIG. 2. A bore 26 is also provided in either end of the hanger bar 24, and a pivot pin 27 is journaled within both the pivot pin bore 25 in the pivot block 23, and the bore 26 in an end of the hanger bar 24. This means of attachment allows for what can be called a positive self alignment function, wherein upon installation, the various components in the assembly will be distributed such that the sliding transit car door 14 is properly aligned in its desired location at the entry portal 18 of the transit car 12, particularly desirable for curved transit car doors. Preferably, there is at least a small clearance c between the lower edge of the hanger bar 24 and the top of the sliding door 14 to allow for such considerations as variation in the surfaces, door curvature, manufacturing tolerances, and to reduce wear.

Figure 4:
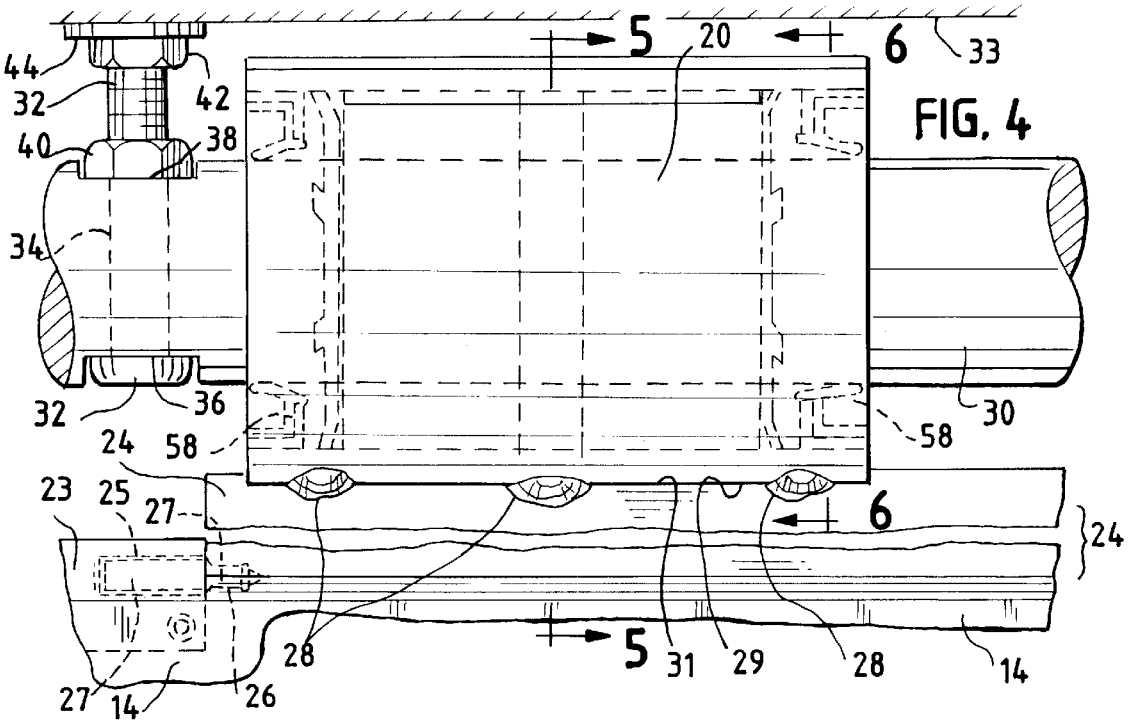
FIG. 4 is an enlarged plan view, taken along lines 4—4 of FIG. 3, of a tubular bearing segment mounted to a hanger bar to which a transit car door is attached, with the tubular bearing segment slideably engaged with a cylindrical rod of the door hanger assembly.
Figure 5:
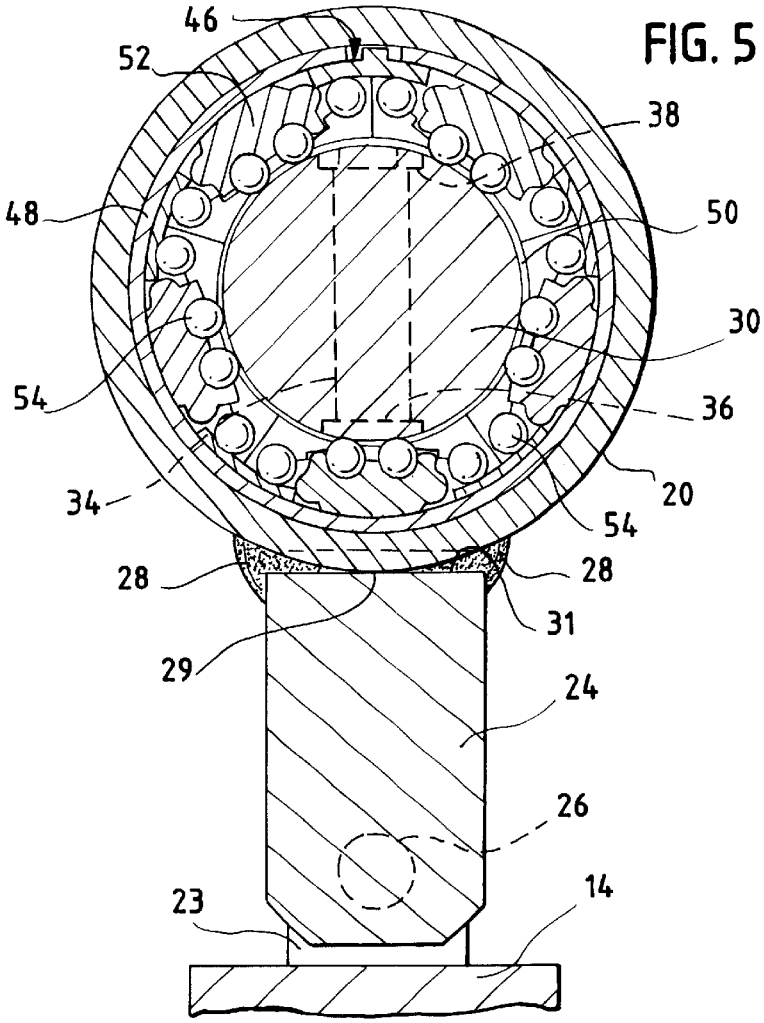
FIG. 5 is a cross-sectional view, taken along lines 5—5 of FIG. 4, of the tubular bearing segment mounted to the hanger bar, with the tubular bearing segment slideably engaged with a cylindrical rod of the door hanger assembly, showing one type of bearing means that may be employed, namely a roller bushing bearing.

As shown in FIGS. 4 and 5, one way to secure the tubular bearing segment 20 to the hanger bar 24 is to weld the tubular bearing segment 20 along its lower edge 29 to the hanger bar 24. The welds are referenced in the drawings by reference number 28. Advantageously, because the two (or more) tubular bearing segments 20, 22 are independent of one another, each can be welded, or otherwise secured, to a desired location along the hanger bar 24, taking into account such considerations as: the locations above the entry portal 18 of the transit car where the hanger bar assembly 10 is supported, the location where the sliding door 14 interfaces with an adjacent sliding door 16, the width of each of the doors 14, 16, which would generally be slightly greater than half the width of the entry portal 18, and the distance the given sliding door 14 or 16 must travel along a cylindrical rod 30, which slidingly receives the tubular bearing segments 20, 22.

In order to minimize the overall height of the hanger assembly 10, once the locations along the hanger bar 24 for the tubular bearing segments 20, 22 are selected for use in a given transit car 12, elongated depressions 31 are milled into the top of the hanger bar 24, one of the elongated depressions 31 receiving each of the tubular bearing segments 20, 22 prior to welding. Such elongated depressions 31 also serve to help maintain axial alignment and perpendicularity of the tubular bearing segments 20, 22. Thus, the hanger bar 24 preferably has a top 35 extending substantially the length thereof, with two or more flat recesses or elongated depressions 31, with each of the elongated depressions 31 receiving one of the tubular bearing segments 20, 22. To provide the greatest area of contact between the lower edge 29 of the hanger bar 24 and the tubular bearing segment 20 so as to facilitate welding the elongated depression may have a curved, concave profile that is complementary to the outer wall of the tubular bearing segment 20, 22, such as the elongated depression 31 a of the hanger bar 24*a* shown in FIG. 8. Alternatively, the entire top of the hanger bar could have such a curved profile.

In a certain embodiment of the present invention, the cylindrical rod 30, along which the tubular bearing segments 20, 22 slide, is attached to a structural support 33 (or to any suitable frame member) positioned above the entry portal 18 of the transit car 12 by being pinned at two or more locations along the cylindrical rod 30 with conventional nuts and bolts, most preferably only at each end of the cylindrical rod 30. While it is recognized that a single cylindrical rod could be used for both sliding transit car doors 14, 16, such a single cylindrical rod would generally need to be of a relatively large diameter in order to avoid excessive deflection, so it is preferable to use a separate cylindrical rod 30 for each transit car door 14, 16.

As shown in FIG. 4, a bolt 32 is received in a bolt-receiving bore 34 of the cylindrical rod 30. The cylindrical rod 30 may advantageously be provided with a first flat countersunk region 36 milled into an underside of the cylindrical rod to receive the head of the bolt 32, and a second flat countersunk region 38 milled directly opposite the first flat countersunk region 36, which provides a flat bearing surface to receive a first nut 40. A second nut 42 and, preferably, a washer 44 are used to secure the bolt 32 to the structural support 31 above the entry portal 18.

Turning now to FIG. 5, in certain embodiments of the present invention, there is a bearing means provided within each tubular bearing segment 20, 22, and one such advantageous bearing means is a ball bushing bearing 46, such as the bearing sold under the trademark "Super Smart Ball Bushing" bearing, by Thomson Industries, Inc. of Manhasset, N.Y. Such a ball bushing bearing 46 includes a hardened precision ring 48, an inner retainer 50, double track bearing plates 52, which facilitate self-alignment of the ball bushing bearing 46, and a plurality of ball bearings 54.

It is recognized that there are several possible ways to retain the ball bushing bearing 46 in position within the tubular bearing segment 20. One such retention means would take the form of a pair of inwardly-projecting annular ridges provided within the tubular bearing segment 20 on either side of the ball bushing bearing 46. Such annular ridges could be integral with the tubular bearing segment 20, or alternately, a pair of annular grooves could be provided within the inner wall of the tubular bearing segment 20 to receive, for example, a snap ring immediately adjacent either end of the ball bushing bearing 46. Each of these alternatives require additional machining of the tubular bearing segment 20.

Thus, another desirable manner in which to retain the ball bushing bearing 46 in position within the tubular bearing segment 20 is to employ an internal retaining ring 60, available from Thomson Industries, Inc. as Part No. PR-1000, immediately adjacent either side of the ball bushing bearing 46. Such internal retaining rings 60 are preferably press-fit in place, and are sized so as to retain the ball bushing bearing 46 in position relative to the tubular bearing segment 20 without requiring any additional machining of the tubular bearing segment 20. In order to exclude dirt and other contaminants from entering the tubular bearing segment 20 and potentially disrupting smooth travel of the ball bushing bearing 46 along the cylindrical rod 30, an oil sealing gasket 58, such as an external seal 62 for use with fixed diameter housings, also available from Thomson Industries, Inc. as Part No. S-1000, is preferably provided, by a press fit, in each end of the tubular bearing segment 20. Such external seals 62 advantageously include an elastomeric material that reduces grease, oils, dirt and other potential contaminants that may collect or be deposited on the cylindrical rod 30 as the transit car doors 14, 16 open and close, thereby preventing such potential contaminants from entering the interior of the ball bushing bearing 46.

It is recognized that if it were desired to avoid welding of the tubular bearing segments 20, 22 to the hanger bar 24, another manner, not shown in the drawings, of securing each of the tubular bearing segments 20, 22 to the hanger bar 24 would be to provide a hanger bar in which the elongated depression 31 is deeper than the wall thickness of a lip at each end of each tubular bearing segment which extends past the retaining ring 60 and external seal 62 provided in the tubular bearing segment to keep dirt and other contaminants away from the bearing member. The lip at one or both ends of the tubular bearing segment 20, 22 could be notched at one or more portions along its circumference, and the hanger bar 31 would be provided with complementary finger-like tubular bearing segment retaining projections at the top of the elongated depression 31, approximately the length of the axial length of each of the lips. The notches of the tubular bearing segments would be inserted past the finger-like tubular bearing segment retaining portions at the top of the elongated depression of the hanger bar, and then the tubular bearing segment would be rotated, thereby locking the tubular bearing segment to the hanger bar.

In order to keep the tubular bearing segment from rotating such that the notches in the lips re-align with the finger-like tubular bearing segment retaining portions, which could undesirably cause premature disconnection of the tubular bearing segment and hanger bar, some welds could still be used, or alternatively, pins could be inserted in apertures formed in suitable locations of the tubular bearing segments to limit excessive rotation of the tubular bearing segments. In addition to minimizing, or avoiding altogether the need for welding of the tubular bearing segment to the hanger bar, such an interlocking tubular bearing segment and hanger bar design would increase the stiffness of the hanger and achieve an efficient transfer of loads between the tubular bearing segment and the hanger bar. The hanger bar 24*b* shown in FIG. 9 is of a desirable shape for this alternate, non-welded, manner of securement of the tubular bearing segment 20, 22 to the hanger bar.

Figure 7:
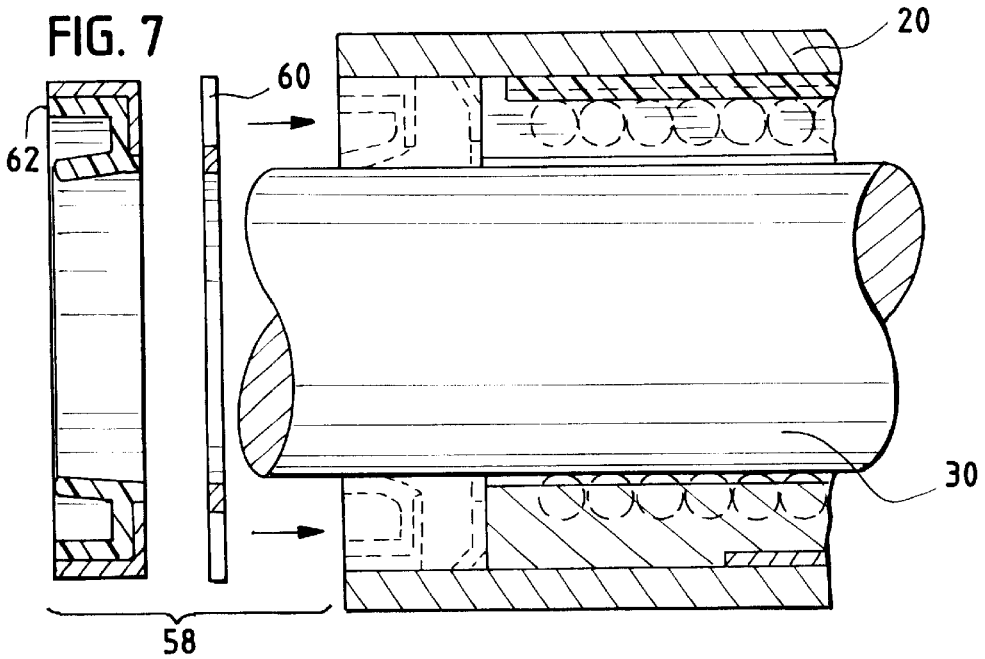
FIG. 7 is a cross-sectional view, taken along lines 7—7 of FIG. 6, which has been exploded to more clearly show the seals provided at an end of the tubular bearing segment, and with the final position of the seals relative to the tubular bearing segment being shown in phantom lines.

Turning back to FIG. 4, it should also be noted that the first and second ends of the hanger bar 24 could terminate either at a first end of the first tubular bearing segment 20 and at a second end of the second tubular bearing segment 20, respectively, or alternatively, extend beyond the first end of the first tubular bearing segment 20 and/or the second end of the second tubular bearing segment 20, depending on the geometric requirements of any particular transit car application. This is an advantage, particularly in applications which the hanger assembly 10 is used in some refurbishing capacity where the support 33 on the transit cars would be difficult and costly to relocate. In addition, as shown in FIG. 7, the hanger bar 24 of certain embodiments of the present invention not only locates the two tubular bearing segments, but also provides the rigid member which supports the sliding door, even if the hanger bar extends past the first end of the first tubular bearing segment 20 and/or past the second end of the second tubular bearing segment 20.

Figure 6:
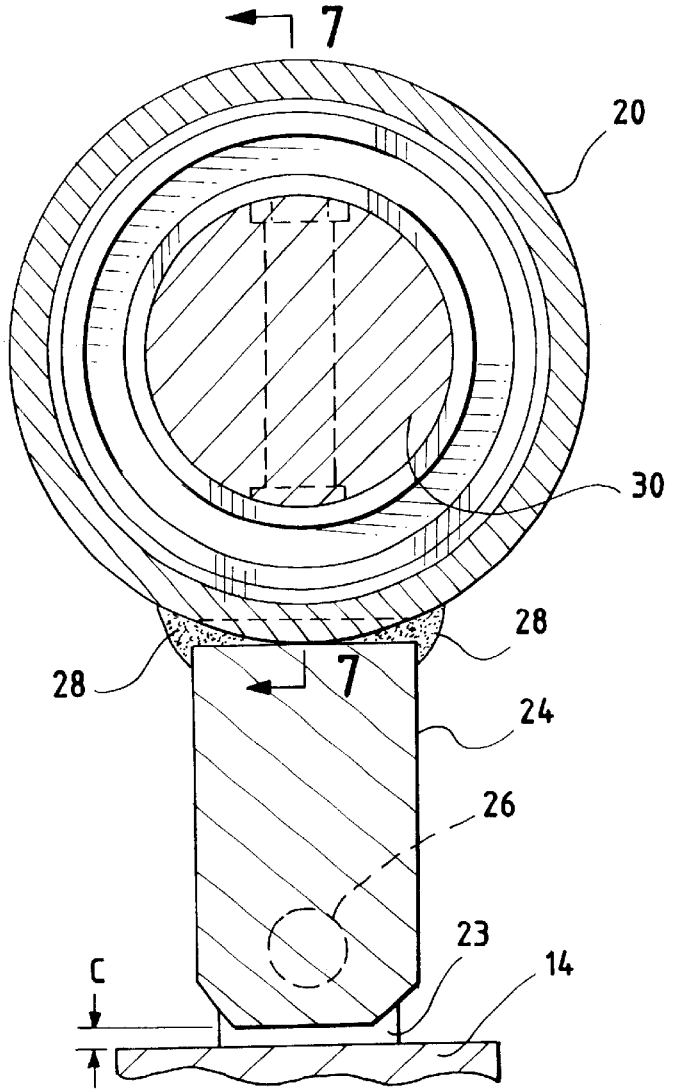
FIG. 6 is a cross-sectional view, taken along lines 6—6 of FIG. 4, of the tubular bearing segment mounted to the hanger bar, showing seals provided at an end of the tubular bearing segment.
Figure 10:
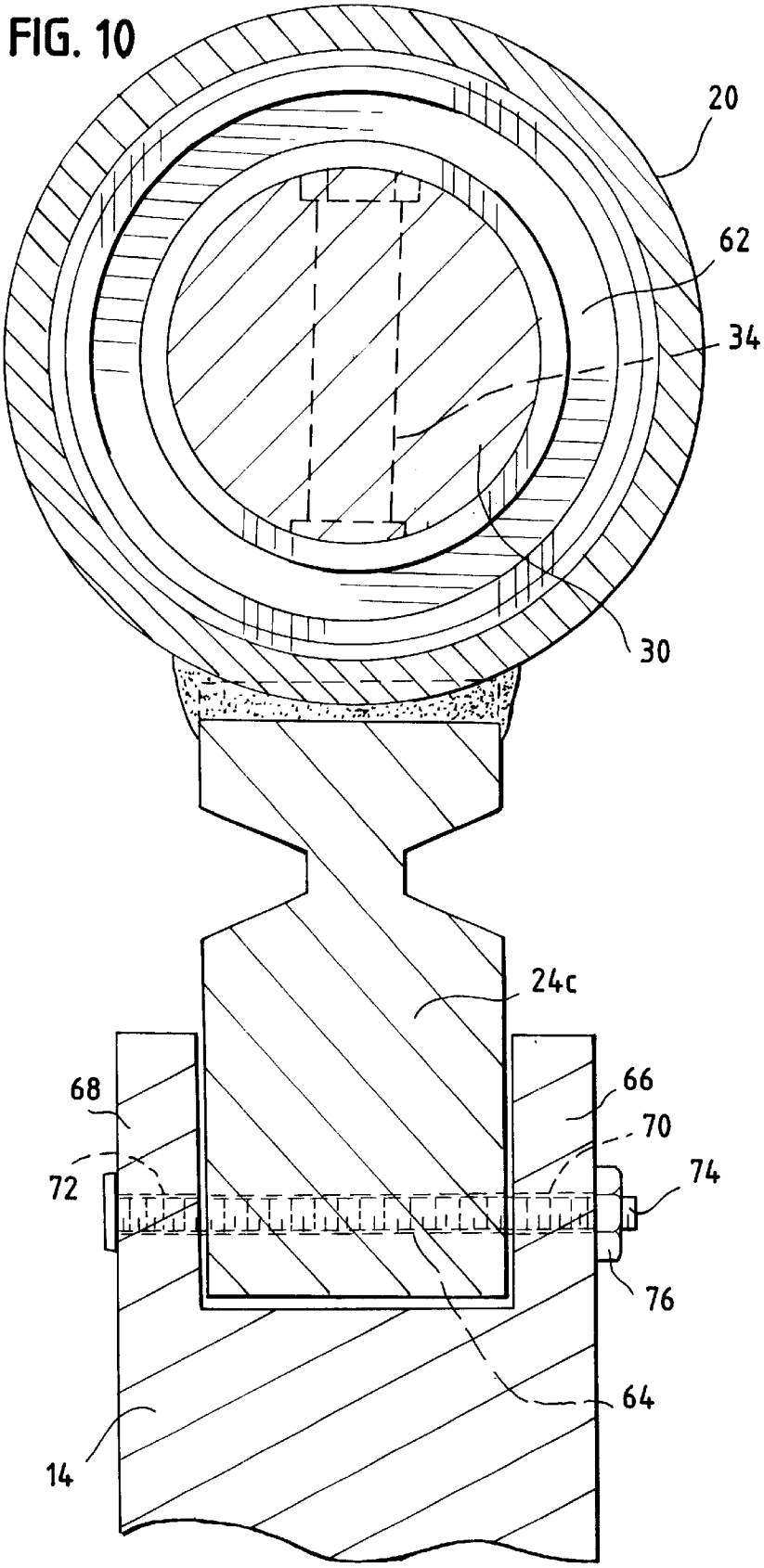
FIG. 10 is a cross-sectional view, similar to FIG. 7, but showing an exemplary embodiment of the present invention in which a hanger bar of still another shape than the hanger bars shown in FIGS. 5, 6, 8 and 9, and wherein the hanger bar is connected directly to the top of a sliding transit car door.

Turning now to FIG. 10, a hanger bar 24*c* is shown having yet a different shape from the hanger bars shown in FIGS. 5, 6, 8 and 9. Furthermore, instead of a bore 26 of the type shown in FIGS. 4–6 provided in each end of the hanger bar 24, which receives a pivot pin 27 extending from a pivot block 23 provided on top of the sliding transit car door 14, the embodiment of the present invention shown in FIG. 10 demonstrates a different manner of securement of the hanger bar 24*c* to the sliding door 14. In the embodiment shown in FIG. 10, the hanger bar 24*c* has a plurality of bores 64 extending through the width of a lower portion of the hanger bar 24*c*. The sliding transit car door 14 in this embodiment has an elongated U-shaped groove in the top thereof, having a first leg 66 and a second leg 68. The lower portion of the hanger bar 24*c* is received in the elongated U-shaped groove in the top of the transit car door 14. Each bore 64 is aligned with a pair of coaxial bores 70, 72 provided in the first and second legs 66, 68, respectively. A fastener, such as a bolt 74 extends through the aligned bores 72, 64, 70 and can be secured in place with a nut 76.

Inasmuch as this embodiment does not allow for pivoting of the transit car door 14 relative to the hanger bar 24*c*, it may be considered better suited for use with flat transit car doors, as opposed to curved transit car doors. However, it is recognized that while the positive self alignment capability may be effected to some degree in this embodiment, as compared to embodiments using the pivot block manner of attaching the transit car door 14 and hanger bar 24 shown in FIGS. 4–6, an advantageous feature of many embodiments of the present invention, including that shown in FIG. 10, is that the tubular bearing segments 20, 22 are capable of rotating about the cylindrical rod 30, thereby still permitting some degree of self alignment of the assembly upon installation, and allowing for the direct attachment of the hanger bar 24*c* to top of the transit car door 14 even if the transit car door has some curvature. In such an instance, the hanger bar 24*c* could be oriented at an angle relative to a vertical axis through the cylindrical rod 30.

It will be understood by those of ordinary skill in the art that, while certain embodiments have been disclosed herein, various modifications can be made thereto without departing from the scope of the appended claims.

What is claimed is:

1. An assembly for suspending sliding transit car doors comprising:

a cylindrical rod suspended above an entry portal of a transit car;

a hanger bar having a transit car door suspended therefrom;

a first tubular bearing segment secured to the hanger bar at a first location along said hanger bar and said first tubular bearing segment slidably receiving said cylindrical rod;

a second tubular bearing segment secured to the hanger bar at a second location along said hanger bar coaxially with said first tubular bearing segment in relation to the cylindrical rod, said second tubular bearing segment being spaced a predetermined distance from said first tubular bearing segment and said second tubular bearing segment being separate from said first tubular bearing segment, wherein said hanger bar includes a top extending substantially the length thereof, and further includes at least two elongated depressions in said top, each of said elongated depressions receiving a lower edge of one of said tubular bearing segments.

2. The assembly of claim 1, wherein said at least two elongated depressions in the hanger bar are substantially flat and coplanar with one another, and said at least two tubular bearing segments have equal thickness and diameters to one another, whereby said elongated depressions facilitate coaxial alignment of said at least two tubular bearing segments.

3. The assembly of claim 1, wherein each of said at least two elongated depressions in the hanger bar is of a concave profile which is complementary to the lower edge of said tubular bearing segments.

4. An assembly for suspending sliding transit car doors comprising:

a cylindrical rod suspended above an entry portal of a transit car;

a hanger bar having a bore in each end thereof;

a pair of pivot blocks provided along a top of a suspended sliding transit car door, one of said pivot blocks being disposed adjacent each end of said hanger bar, each of said pivot blocks having a pivot pin bore therein, said pivot pin bore being oriented in axial alignment with said bore in a respective end of the hanger bar;

a pair of pivot pins, one of said pins being journaled between one of the pivot pin bores of the pivot block and the bore in the respective end of the hanger bar;

a first tubular bearing segment secured to the hanger bar at a first location along said hanger bar and said first tubular bearing segment slidably receiving said cylindrical rod; and a second tubular bearing segment secured to the hanger bar at a second location along said hanger bar coaxially with said first tubular bearing segment in relation to the cylindrical rod, said second tubular bearing segment being spaced a predetermined distance from said first tubular bearing segment and said second tubular bearing segment being separate from said first tubular bearing segment, whereby said second location is determined independently of said first location, each of said first and second tubular bearing segments including a ball bushing bearing secured therein to facilitate sliding motion of said first and second tubular bearing segments along said cylindrical rod wherein said hanger bar further including a top extending substantially the length thereof; and at least two elongated depressions in said top, each of said elongated depressions receiving a lower edge of one of said tubular bearing segments.

5. The assembly of claim 4, wherein said at least two elongated depressions in the hanger bar are substantially flat and coplanar with one another, and said at least two tubular bearing segments have equal thickness and diameters to one another, whereby said elongated depressions facilitate coaxial alignment of said at least two tubular bearing segments.

6. The assembly of claim 5, wherein each of said tubular bearing segments is welded to the hanger bar.

7. The assembly of claim 4, wherein each of said tubular bearing segments includes a pair of retaining rings, one of said retaining rings disposed adjacent each of said ends of said ball bushing bearing, and a pair of external seals, each of said external seals being disposed axially outwardly of one of said retaining rings relative to the ball bushing bearing.

8. The assembly of claim 4, wherein each of said at least two elongated depressions in the hanger bar is of a concave profile which is complementary to the lower edge of said tubular bearing segments.

9. An assembly for suspending sliding transit car doors comprising:

a cylindrical rod suspended above an entry portal of a transit car;

a suspended sliding transit car door having a top provided with a pair of horizontally aligned pivot blocks thereon, and said door including a pair of vertical edges, one of said pivot blocks being located adjacent each of said vertical edges, each of said pivot blocks including a horizontally oriented pivot pin bore therein, said pivot pin bore in one of the pivot blocks facing the pivot pin bore in the other of said pair of pivot blocks;

a pair of pivot pins, one of said pivot pins received in and extending outwardly of each of said pivot pin bores;

a hanger bar extending between said pivot blocks and having a bore in each end thereof receiving a portion of one of the pivot pins projecting from a respective pivot block, said bores being axially aligned with one another;

a first tubular bearing segment secured to the hanger bar at a first location along said hanger bar and said first tubular bearing segment slidably receiving said cylindrical rod;

a second tubular bearing segment secured to the hanger bar at a second location along said hanger bar coaxially with said first tubular bearing segment in relation to the cylindrical rod, said second tubular bearing segment being spaced a predetermined distance from said first tubular bearing segment and said second tubular bearing segment being separate from said first tubular bearing segment, whereby said second location is determined independently of said first location; and each of said first and second tubular bearing segments including a ball bushing bearing secured therein to facilitate sliding motion of said first and second tubular bearing segments along said cylindrical rod, said hanger bar further including a top extending substantially the length thereof and at least two elongated depressions in said top, each of said elongated depressions receiving a lower edge of one of said tubular bearing segments.

10. The assembly of claim 9, wherein said at least two elongated depressions in the hanger bar are substantially flat and coplanar with one another, and said at least two tubular bearing segments have equal thickness and diameters to one another, whereby said elongated depressions facilitate coaxial alignment of said at least two tubular bearing segments.

11. An assembly for suspending sliding transit car doors comprising:

a cylindrical rod suspended above an entry portal of a transit car;

a suspended sliding transit car door having a top provided with a pair of horizontally aligned pivot blocks thereon, and said door including a pair of vertical edges, one of said pivot blocks being located adjacent each of said vertical edges, each of said pivot blocks including a horizontally oriented pivot pin bore therein, said pivot pin bore in one of the pivot blocks facing the pivot pin bore in the other of said pair of pivot blocks;

a pair of pivot pins, one of said pivot pins received in and extending outwardly of each of said pivot pin bores;

a hanger bar extending between said pivot blocks and having a bore in each end thereof receiving a portion of one of the pivot pins projecting from a respective pivot block, said bores being axially aligned with one another;

a first tubular bearing segment secured to the hanger bar at a first location along said hanger bar and said first tubular bearing segment slidably receiving said cylindrical rod;

a second tubular bearing segment secured to the hanger bar at a second location along said hanger bar coaxially with said first tubular bearing segment in relation to the cylindrical rod, said second tubular bearing segment being spaced a predetermined distance from said first tubular bearing segment and said second tubular bearing segment being separate from said first tubular bearing segment, whereby said second location is determined independently of said first location; and each of said first and second tubular bearing segments including a ball bushing bearing secured therein to facilitate sliding motion of said first and second tubular bearing segments along said cylindrical rod, wherein each of said at least two elongated depressions in the hanger bar is of a concave profile which is complementary to the lower edge of said tubular bearing segments.

* * * * *

UNITED STATES PATENT AND TRADEMARK OFFICE

CERTIFICATE OF CORRECTION

PATENT NO. : 6,640,388 B2 
DATED : November 4, 2003
INVENTOR(S) : Jeffrey W. Covert et al.

It is certified that error appears in the above-identified patent and that said Letters Patent is hereby corrected as shown below:

Column 8,
Lines 60-62, delete "… rod wherein said hanger bar further including a top extending substantially the length thereof;" and insert -- … rod, said hanger bar further including a top extending substantially the length thereof --.

Signed and Sealed this

Eleventh Day of May, 2004

JON W. DUDAS
*Acting Director of the United States Patent and Trademark Office*